US006269778B1

(12) United States Patent
Anderson et al.

(10) Patent No.: US 6,269,778 B1
(45) Date of Patent: Aug. 7, 2001

(54) FINE SOLIDS RECYCLE IN A CIRCULATING FLUIDIZED BED

(75) Inventors: Gary L. Anderson, Blair Township, Blair County, PA (US); Mikhail Maryamchik, Copley Township, Summit County; Donald L. Wietzke, Copley, both of OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/464,258

(22) Filed: Dec. 17, 1999

(51) Int. Cl.[7] ..... F27B 15/08

(52) U.S. Cl. ..... 122/4 D; 110/245; 422/145; 422/147

(58) Field of Search ..... 122/4 D, 34; 110/216, 110/245; 55/444; 422/145, 147

(56) References Cited

U.S. PATENT DOCUMENTS 4,747,852 * 5/1988 Engstrom ..... 422/147
4,931,260 * 6/1990 Molerus et al. ..... 422/147
4,969,930 * 11/1990 Arpalahti ..... 122/4 D
5,343,830 9/1994 Alexander et al. .
5,345,883 * 9/1994 Panos ..... 122/4 D
5,463,968 * 11/1995 Abdulally ..... 122/4 D
5,682,828 * 11/1997 Phalen et al. ..... 122/4 D
6,067,943 * 5/2000 Morin et al. ..... 122/4 D

OTHER PUBLICATIONS

Aerodynamic Calculation of Boiler Units (Standard Method), Third Edition—Edited By S.I. Mochan—copyright page and p. 79 and 87.

* cited by examiner

*Primary Examiner*—Gregory Wilson
(74) *Attorney, Agent, or Firm*—Robert J. Edwards; Eric Marich

(57) ABSTRACT

A CFB furnace or reactor unit is provided having enhanced circulation of the reagents finest particles. The improved circulation is achieved by recycling gas having entrained fine particles from a solids collection hopper connected to the solids separator back into the reactor. A system of one or more conduits connects the upper portion of the solids collection hopper with the reactor. The conduit system is equipped with means for recycling gas from the hopper to the reactor. The invention is an inexpensive system which permits recycling of the finest particles that would otherwise be carried over with the gas flow exiting the separator.

13 Claims, 6 Drawing Sheets

FINE SOLIDS RECYCLE IN A CIRCULATING FLUIDIZED BED

FIELD AND BACKGROUND OF THE INVENTION

1. Field of the Invention

The present invention relates generally to the field of circulating fluidized bed (CFB) reactors, combustors or boilers and, in particular, to a simple system which permits recycling of the finest particles that would otherwise be carried over with the gas flow exiting a separator used in combination with such CFB reactors, combustors or boilers. The invention thus permits enhanced utilization of reagents in such CFB equipment.

2. Description of the Related Art

A necessary condition for efficient utilization of reagents in a CFB reactor, combustor or boiler, such as combustion of fuel and/or sulfation of sorbent in a CFB boiler, is reagent particle circulation in the unit providing sufficient residence time for reactions to complete. This is achieved by solids separation from gases leaving the reactor and recycling these solids back to the unit.

The solids recycle systems may be single-stage or multi-stage. For a CFB boiler, as shown in FIG. 1, a single-stage system typically includes a cyclone separator 10 located downstream of the furnace 20 and a solids recirculation loop comprised of a standpipe 30 connected to a lower portion 35 of the cyclone 10 and a non-mechanical device 40 to seal against gas by-passing the separator. For example, the non-mechanical device 40 can be a syphon valve.

A double-stage system may include two cyclones connected in series (not shown in the Figures), each having its own recirculation loop, or an impact-type particle separator 11, as shown in FIG. 2. The impact-type particle separator 11 is typically an array of U-shaped beams or similarly shaped elements arranged at the furnace exit 21. A secondary particle collection device 31 is positioned after the impact-type particle separator 11 (downstream with respect to a flow of gases and entrained particles through the CFB reactor). A common secondary particle collection device 31 is a mechanical dust collector, such as a multicyclone or multiclone dust collector (MDC). In this type of system, the bulk of the solids leaving the furnace 20 are collected and recycled by the primary stage particle separator 11, while the secondary stage collects and returns most of the fine particles passing through the primary particle separator 11 back to the furnace 20.

The CFB process could benefit if the above-identified particle separation/collection devices were more effective in collecting fine particles from the flue gases. The effect is that fewer fine particles are recycled prior to leaving the CFB unit, and thus less time is available for reaction of the particles. Although fine particles require less reaction time, the majority of unreacted material exiting the system, such as unburned carbon and unsulfated sorbent in CFB boilers, is concentrated in the finest particles. These fine particles usually have diameters below 50–70 microns.

Fine particles of this size are commonly collected in a baghouse or electrostatic precipitator. U.S. Pat. No. 5,343,830 to Alexander et al. discloses one recycling method which recycles the fine particles collected in the baghouse or electrostatic precipitator back to the reactor. flowever, this method requires installation of a complex solids recycle system.

Any notable improvement of fine particle collection in the cyclone or any other inertial-type separation device presently known using increasing swirling and outlet gas velocity, if possible, will result in a prohibitively high pressure drop and increased parts wear.

Alternatively, a mechanical dust collector can be used to increase fine particle collection, as taught by a Russian publication, *Aerodynamic Calculation of Boiler Units* (*Standard Method*), Edited by S. I. Mochan, 3rd Ed., Leningrad, "Energia", 1977. As shown on page 87 thereof, gas is pulled out from the mechanical dust collector ash hopper and recycled back to the mechanical dust collector inlet using a dedicated fan. The recycle gas stream is cleaned of ash using high efficiency cyclones placed in the recycle loop.

Gas flow pulled from the separator in the same direction as collected solids entrains some the finest particles that otherwise would be carried over with the gas flow leaving the separator, thus, improving collection efficiency for those particles. This method does not cause a gas velocity increase in the collecting elements outlet pipes that normally contributes to a large share of the elements' pressure drop and erosion potential.

SUMMARY OF THE INVENTION

It is an object of the present invention to improve utilization of reagents in a CFB reactor unit with a simple, low-cost method and apparatus. The present invention utilizes a similar concept as that described immediately above not only in the context of a CFB reactor unit but also with a simpler arrangement allowing lower capital and operating costs.

Accordingly, a CFB furnace or reactor unit is provided having enhanced circulation of the finest reagents particles. The improved circulation is achieved by recycling gas having entrained fine particles from a solids collection hopper connected to the solids separator back into the reactor. A system of one or more conduits connects the upper portion of the solids collection hopper with the reactor. The conduit system is equipped with means for recycling gas from the hopper to the reactor.

The invention is an inexpensive system which permits recycling of the finest particles that would otherwise be carried over with the gas flow exiting the separator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

As used herein, the term CFB combustor refers to a type of CFB reactor where a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing, or where the reactor merely provides an enclosure wherein particles or solids are entrained in a gas that is not necessarily a byproduct of a combustion process.

Figure 1:
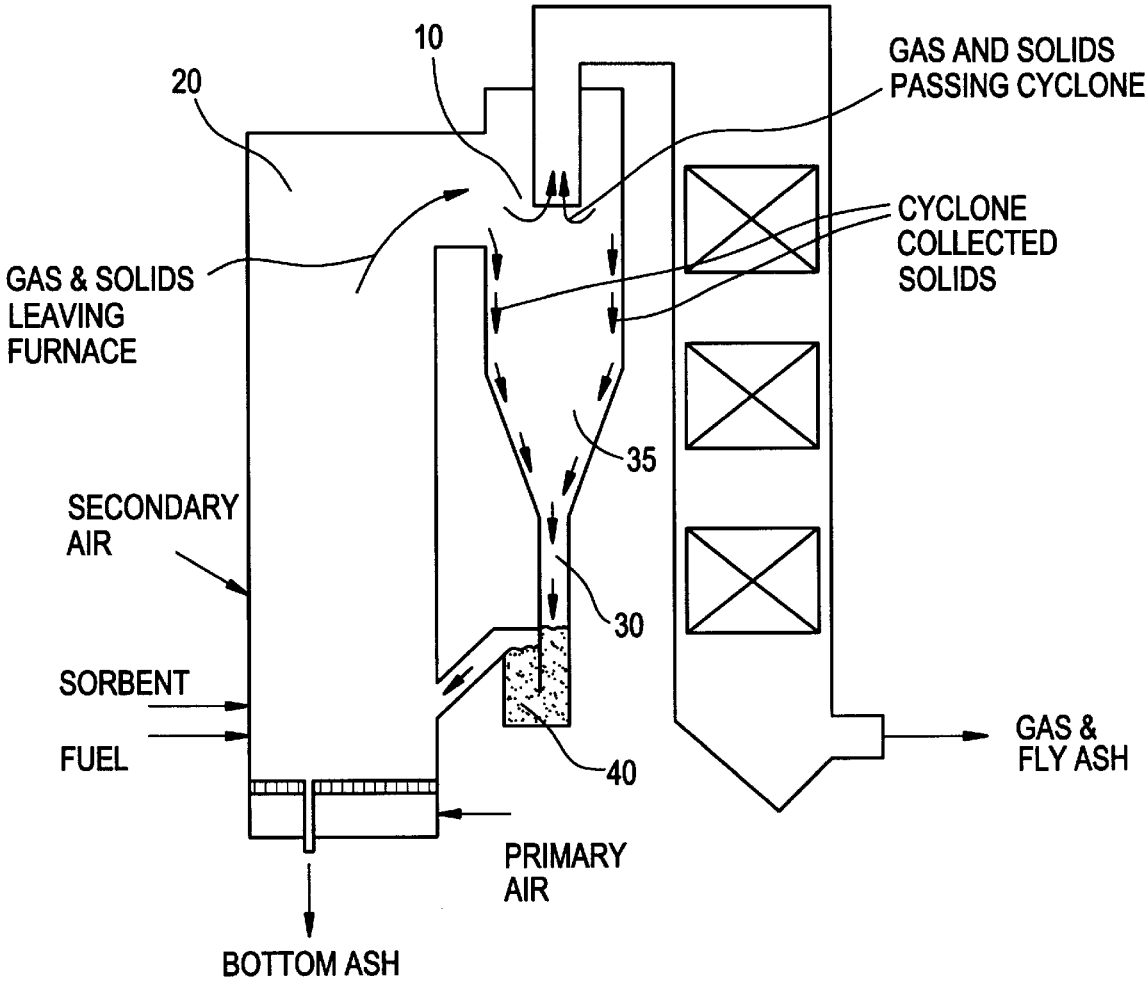
FIG. 1 PRIOR ART
FIG. 1 is a sectional side elevation view of a prior art CFB boiler.
Figure 3:
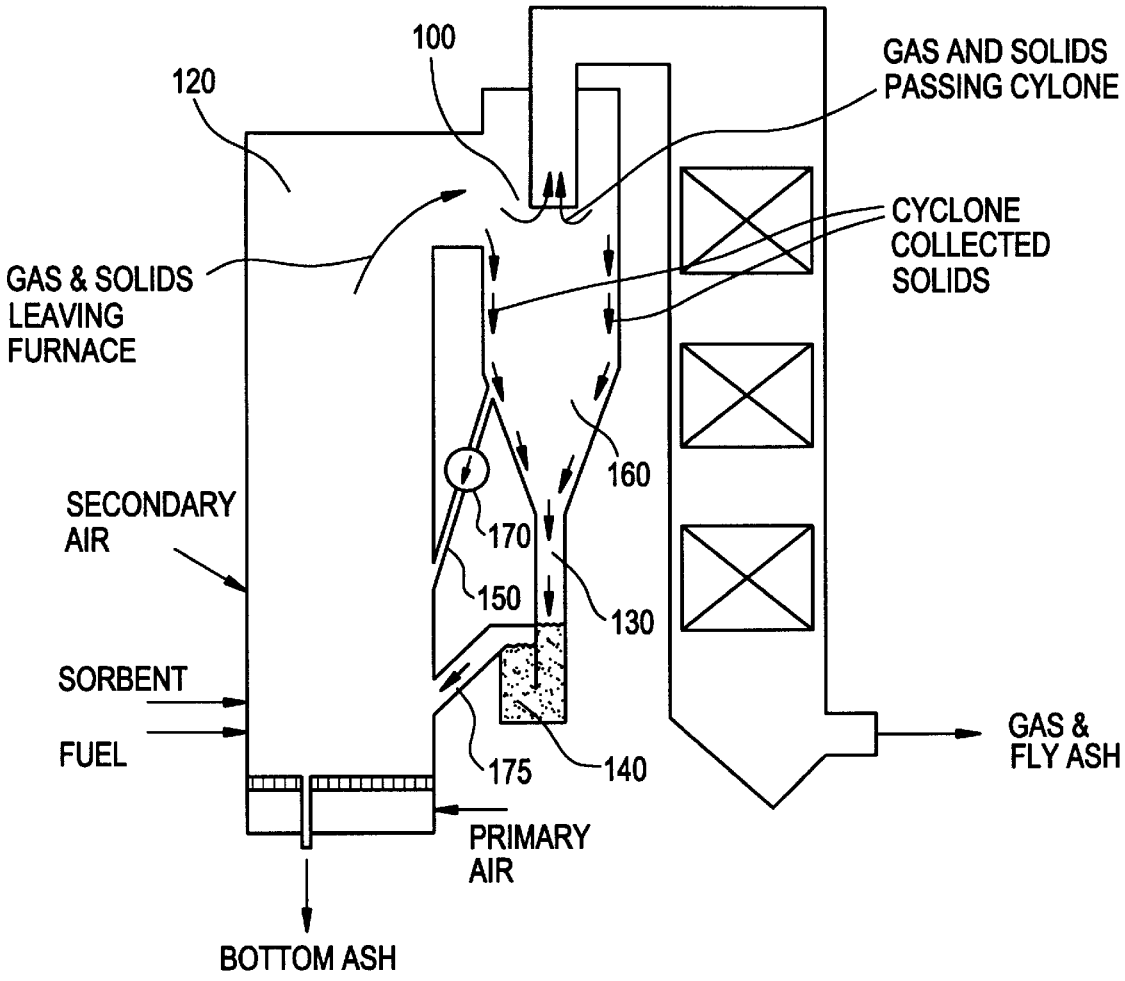
FIG. 3 is a sectional side elevation view of a CFB boiler according to the invention.

Referring now to the drawings, in which like reference numerals are used to refer to the same or functionally similar elements, FIG. 3 illustrates a CFB unit with a single stage solids recycle system, similar to that shown in the prior art system of FIG. 1. As shown in FIG. 3, the improvement of the invention comprises conduit 150 connecting cyclone hopper 160 to the lower end of furnace 120. A device 170 for recycling gas from the hopper 160 to the furnace 120 is provided as part of the conduit 150. The device 170 may be a fan, ejector or similar device.

The single-stage system of FIG. 3 includes a cyclone 100 located downstream of the furnace 120 and solids recirculation loop 175 comprised of a standpipe 130 and a non-mechanical device 140 to seal against gas by-passing the separator. For example, the non-mechanical device 140 can be a syphon-valve.

Figure 2:
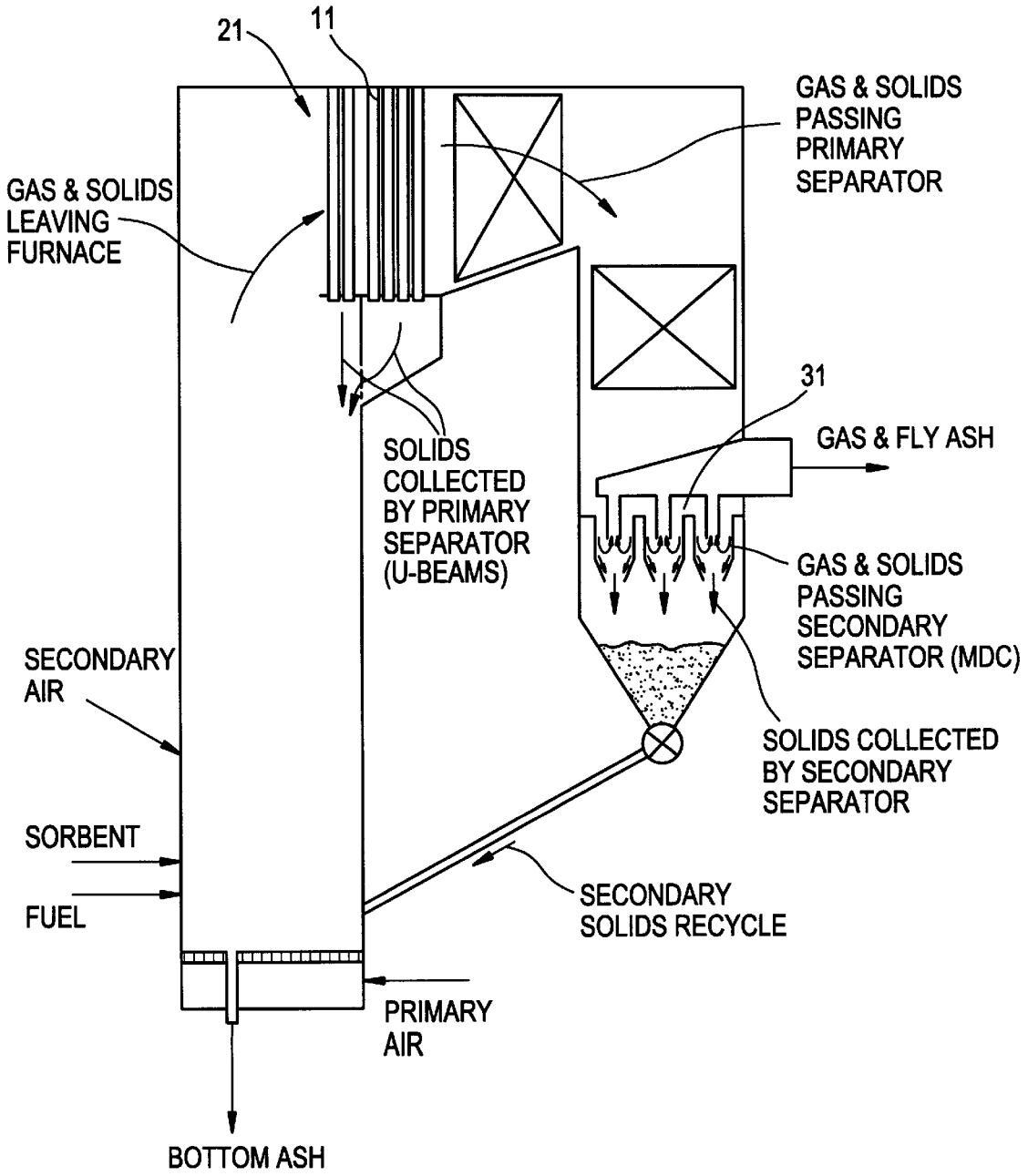
FIG. 2 (PRIOR ART)
FIG. 2 is a sectional side elevation view of another prior art CFB boiler.
Figure 4:
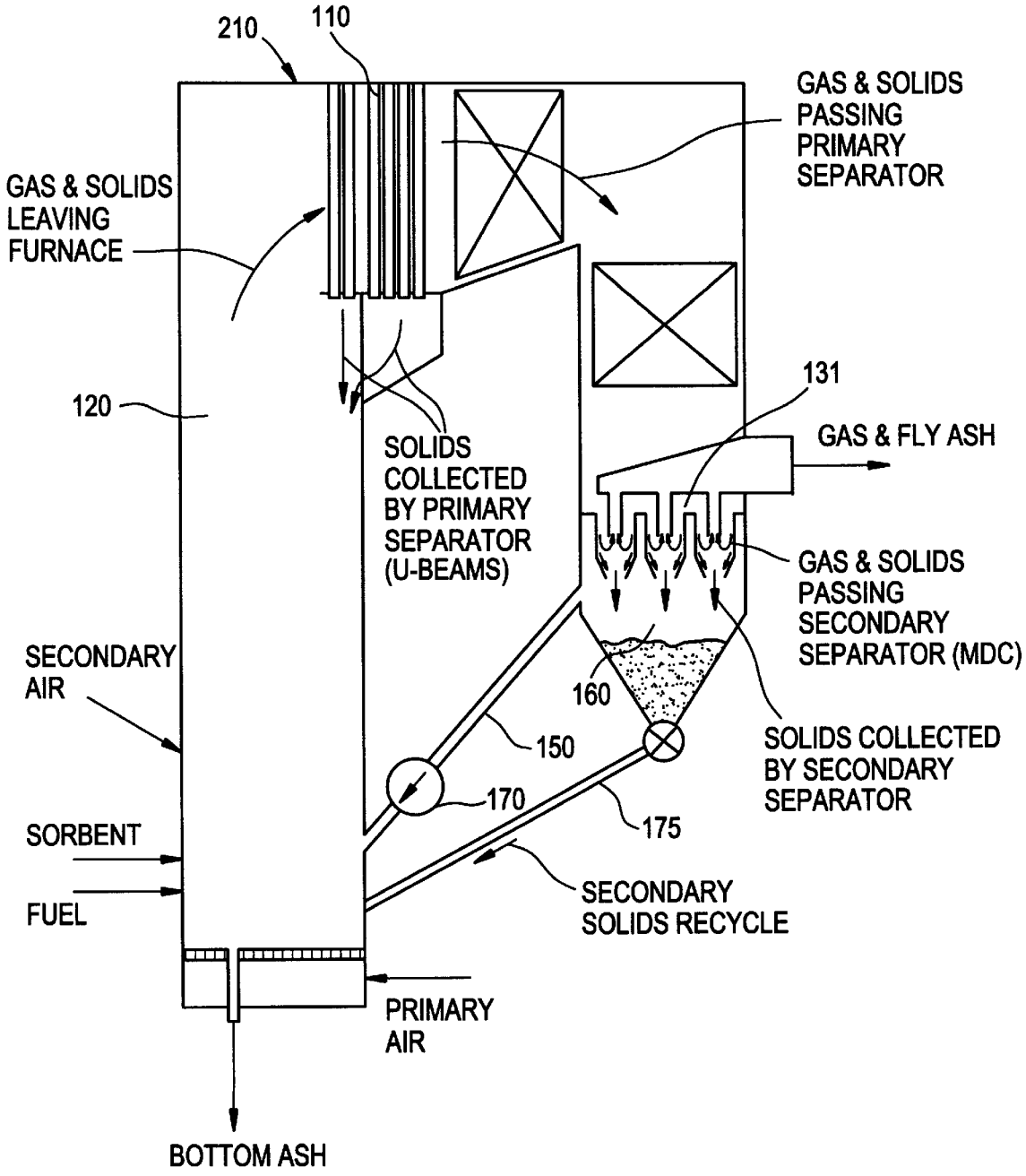
FIG. 4 is a sectional side elevation view of a second embodiment of a CFB boiler according to the invention.

FIG. 4 displays a two-stage system of the type described in FIG. 2 having the invention incorporated therein. In FIG. 4, a conduit 150 has recycling device 170 connected in series between the hopper 160 and furnace 120. The conduit 150 is in communication through the wall of the hopper 160 at a point below the secondary collection device 131, which is illustrated as a multi-cyclone.

The recycling device 170 used in this embodiment of the invention may comprise a fan, ejector or the like.

The conduit 150 is likely to be arranged as a pipe of 8" to 24" diameter (depending on the unit capacity). Use of a "dirty" fan as a recycling device will allow lower auxiliary power consumption while use of a steam or air ejector may be more attractive from arrangement and maintenance view points.

The impact-type separator 110 is typically an array of U-shaped beams or similarly shaped elements arranged at the furnace exit 210.

In each of the embodiments shown in FIGS. 3 and 4, the larger separated solids pass back to the furnace 120 via a solids recirculation loop 175 located below the conduit 150, at the bottom portion of the hopper 160.

Gas with the finest entrained particles is recycled from the solids collection hopper 160 back to the furnace 120 via the conduit 150.

FIGS. 5–9 show five different configurations or embodiments as to how the connection of the conduit 150 may be made to the upper portion of the hopper 160.

Figure 5:
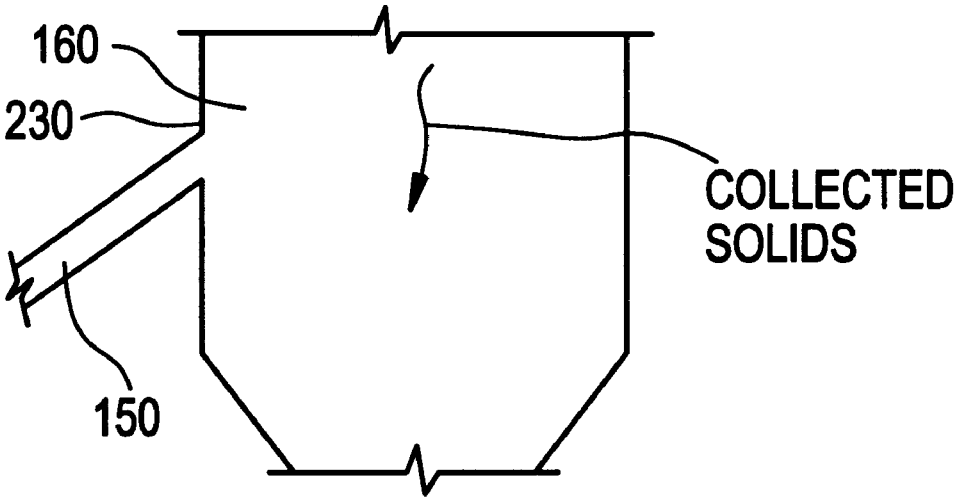
FIG. 5 is a sectional side elevation view of a solids collection hopper of the invention.
Figure 6:
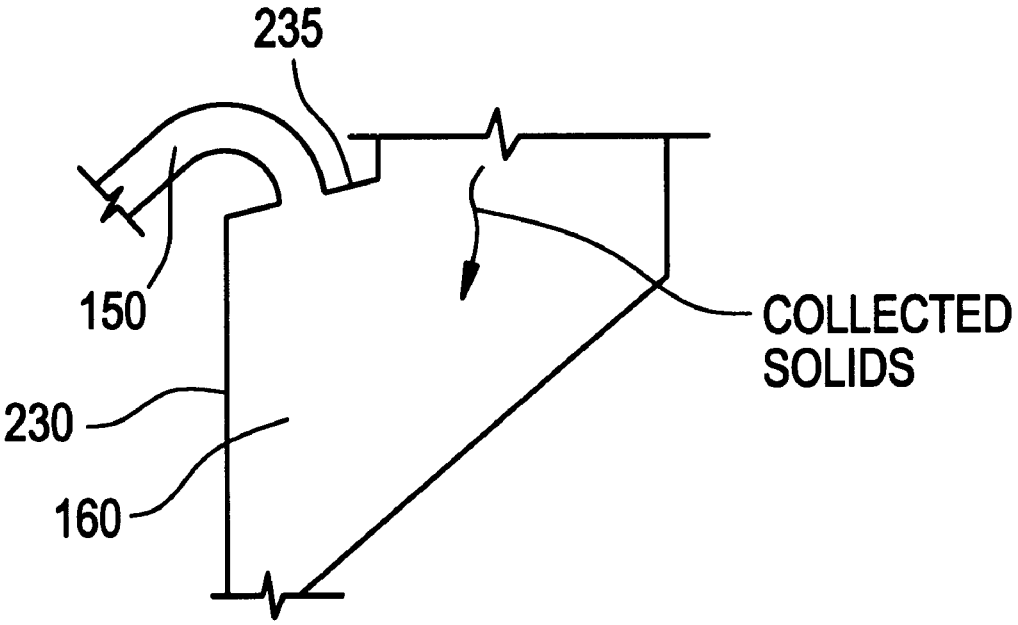
FIG. 6 is a sectional side elevation view of a solids collection hopper according to another embodiment of the invention.
Figure 7:
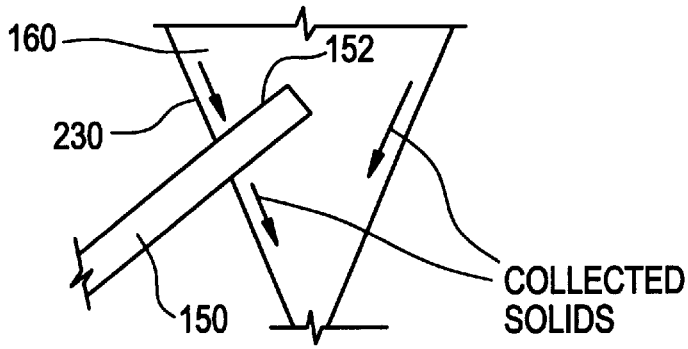
FIG. 7 is a sectional side elevation of yet another embodiment of a solids collection hopper according to the invention.
Figure 8:
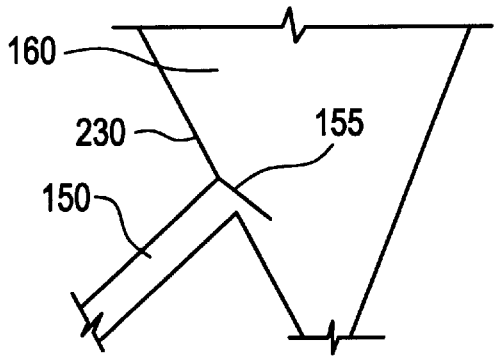
FIG. 8 is a sectional side elevation of yet another embodiment of a solids collection hopper according to the invention.
Figure 9:
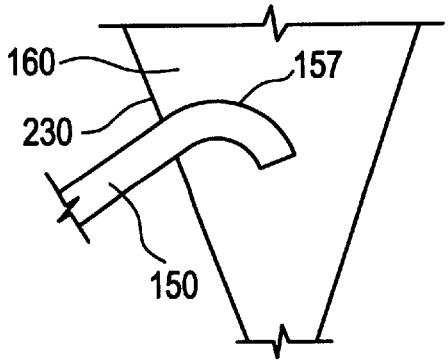
FIG. 9 is a sectional side elevation of yet still another embodiment of a solids collection hopper according to the invention.

In FIG. 5, the end of conduit 150 is flush with the side of hopper 160 and terminates at hopper side wall 230. In FIG. 6, the end of conduit 150 makes a bend upon exiting from the hopper 160, terminating at hopper roof 235. In the remaining embodiments shown in FIGS. 7–9, at least a portion of the conduit 150 or an extension thereof extends through the side wall 230 into the hopper 160. These embodiments are preferred for use when recycling from the cyclone hopper 160 of FIG. 3, since their constructions reduce the potential for entrainment of coarse particles in the recycling gas. The conduit 150 of FIG. 7 extends straight into the hopper 160 past side wall 230 without bending or changing angles. In FIG. 8, the main conduit 150 ends at the side wall, but a plate 155 extends over the opening to the conduit 150 inside the hopper 160 from the interior of side wall 230. The plate 155 could be flat or curved. Finally, in FIG. 9, the end portion 157 of conduit 150 extending inside the hopper 160 is curved downwardly.

Using the invention to recycle gas flow enhances the finest solids recirculation back into the furnace 120 by entraining particles that would otherwise be entrained and carried with gas exiting the separator. The solids-laden gas flowing back to the furnace adds to the overall capacity to recycle where the invention has been installed.

Recycling fine particles using the conduit 150 simplifies the recycling process and reduces the cost of increasing the efficiency of using reagents in a CFB boiler or reactor unit.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving circulating fluidized bed reactors or combustors, or to the replacement, repair or modification of existing circulating fluidized bed reactors or combustors. In some embodiments of the invention, certain features of the invention may be used to advantage without a corresponding use of the other features. Accordingly, all such changes and embodiments properly fall within the scope and equivalents of the following claims.

What is claimed is:

1. A circulating fluidized bed unit having a reactor, at least one solids separator positioned downstream of the reactor, and a solids recirculation loop, the circulating fluidized bed unit having increased finest reagent particle recovery, comprising:

a solids collection hopper connected to the at least one solids separator and connected to the solids recirculation loop;

at least one conduit connecting an upper portion of the solids collection hopper to the reactor, the hopper end of the at least one conduit in communication with the solids collection hopper at a location above the connection of the solids collection hopper to the solids recirculation loop; and gas recirculation means provided for the at least one conduit for recycling gas carrying finest reagent particles from the upper portion of the solids collection hopper to the furnace.

2. The circulating fluidized bed unit according to claim 1, wherein the at least one conduit terminates at an enclosure of the solids collection hopper.

3. The circulating fluidized bed unit according to claim 2, wherein the hopper end of the at least one conduit comprises a plate extending downwardly from an interior of the enclosure of the solids collection hopper over the position where the at least one conduit is attached.

4. The circulating fluidized bed unit according to claim 1, wherein the at least one conduit extends through an enclosure of the solids collection hopper into the solids collection hopper.

5. The circulating fluidized bed unit according to claim 4, wherein the at least one conduit extends straight within the solids collection hopper.

6. The circulating fluidized bed unit according to claim 4, wherein a hopper end of the at least one conduit bends downwardly within the solids collection hopper.

7. A circulating fluidized bed unit having a reactor, at least one multi-cyclone solids separator positioned downstream of the reactor, and a solids recirculation loop, the circulating fluidized bed unit having increased finest reagent particle recovery, comprising:

a solids collection hopper connected to the at least one multi-cyclone solids separator. and connected to the solids recirculation loop;

at least one conduit connecting an upper portion of the solids collection hopper to the reactor, the hopper end of the at least one conduit in communication with the solids collection hopper at a location above the connection of the solids collection hopper to the solids recirculation loop; and gas recirculation means provided for the at least one conduit for recycling gas carrying finest reagent particles from the upper portion of the solids collection hopper to the furnace.

8. The circulating fluidized bed unit according to claim 7, wherein the at least one conduit terminates at an enclosure of the solids collection hopper.

9. The circulating fluidized bed unit according to claim 8, wherein the hopper end of the at least one conduit comprises a plate extending downwardly from an interior of the enclosure of the solids collection hopper over the position where the at least one conduit is attached.

10. The circulating fluidized bed unit according to claim 7, wherein the at least one conduit extends through an enclosure of the solids collection hopper into the solids collection hopper.

11. The circulating fluidized bed unit according to claim 10, wherein the at least one conduit extends straight within the solids collection hopper.

12. The circulating fluidized bed unit according to claim 10, wherein a hopper end of the at least one conduit bends downwardly within the solids collection hopper.

13. A method for increasing recovery and return of the finest reagent particles circulating in a fluidized bed unit to a reactor of the circulating fluidized bed unit, the circulating fluidized bed unit having a reactor, at least one solids separator positioned downstream of the reactor, and a solids recirculation loop, comprising:

providing a solids collection hopper connected to the at least one solids separator and connected to the solids recirculation loop;

providing at least one conduit connecting an upper portion of the solids collection hopper to the reactor;

connecting a hopper end of the at least one conduit through an enclosure of the solids collection hopper so that it is in communication with an upper portion of the solids collection hopper at a location above the connection of the solids collection hopper to the solids recirculation loop; and recirculating gas from and through the at least one conduit for recycling finest reagent particles from the upper portion of the solids collection hopper to the furnace.

* * * * *